United States Patent [19]

Shipinski

[11] 4,176,642

[45] Dec. 4, 1979

[54] DIESEL ENGINE STARTING CONTROL

[75] Inventor: John H. Shipinski, South Beloit, Ill.

[73] Assignee: Deere & Company, Moline, Ill.

[21] Appl. No.: 862,509

[22] Filed: Dec. 20, 1977

[51] Int. Cl.[2] ..... F02M 59/42; F02D 1/04

[52] U.S. Cl. ..... 123/140 R; 123/139 ST; 123/140 FG; 123/179 L

[58] Field of Search ..... 123/140 R, 139 ST, 140 FG, 123/140 MP, 140 MC, 179 L

[56] References Cited

U.S. PATENT DOCUMENTS

| | | | |
|---|---|---|---|
| 2,845,915 | 8/1958 | Frick | 123/140 R |
| 2,945,484 | 7/1960 | Scherenberg et al. | 123/179 L |
| 3,938,487 | 2/1976 | Peltret | 123/139 ST |

FOREIGN PATENT DOCUMENTS

| | | | |
|---|---|---|---|
| 696377 | 8/1940 | Fed. Rep. of Germany | 123/140 R |
| 822343 | 12/1937 | France | 123/140 R |
| 933291 | 8/1963 | United Kingdom | 123/179 L |

*Primary Examiner*—Charles J. Myhre
*Assistant Examiner*—Tony M. Argenbright
*Attorney, Agent, or Firm*—Fraser and Bogucki

[57] ABSTRACT

A starting control for a fuel injected diesel engine retards movement of the fuel injection control rack out of the starting position by a degree which varies with temperature to improve the starting characteristics of the engine without interfering with normal operation of the fuel injection system and its control rack. Movement of the control rack out of the starting position in response to the increasing force exerted by the governor on the control rack coupled floating lever of the fuel injection system is resisted by a damper in the form of a dashpot having a plunger coupled to the floating lever. The dashpot may be coupled to the floating lever by a pivotable crank and a pair of magnets respectively mounted on the crank and the floating lever, the magnets eventually separating to remove the starting control from the fuel injection system when the opposing forces of the governor weights and damper become great enough due to increased engine speed or when the crank reaches an adjustable limit stop. The dashpot plunger which has a one-way check valve mounted therein is quickly returned to the initial position in preparation for restarting or subsequent starting by a spring coupled to the crank. Alternatively, the dashpot plunger is coupled to the control lever by linkage which includes a spring. In this arrangement the starting control not only improves engine starting but also acts to damp and retard rapid motion of the control rack into higher load positions during normal operation so as to minimize unburned fuel and thereby greatly reduce smoke and other air pollution. The amount of retardation provided by the dashpot varies with temperature which in turn varies the viscosity of oil within the dashpot.

11 Claims, 8 Drawing Figures

FIG. 6
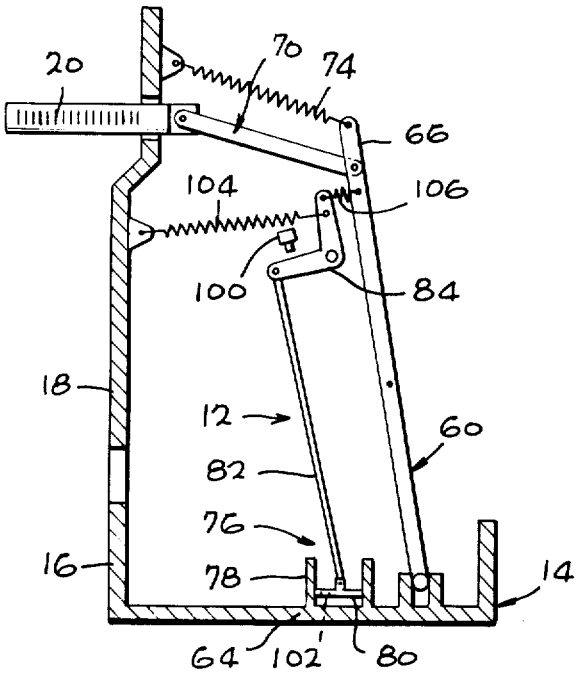
FIG. 7
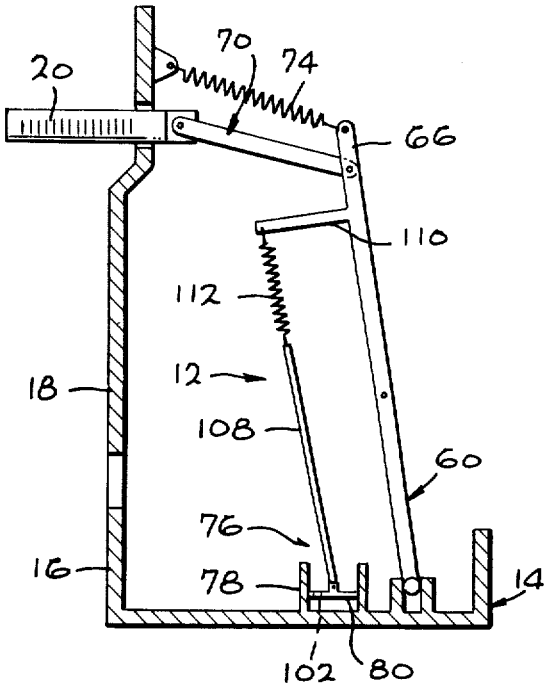
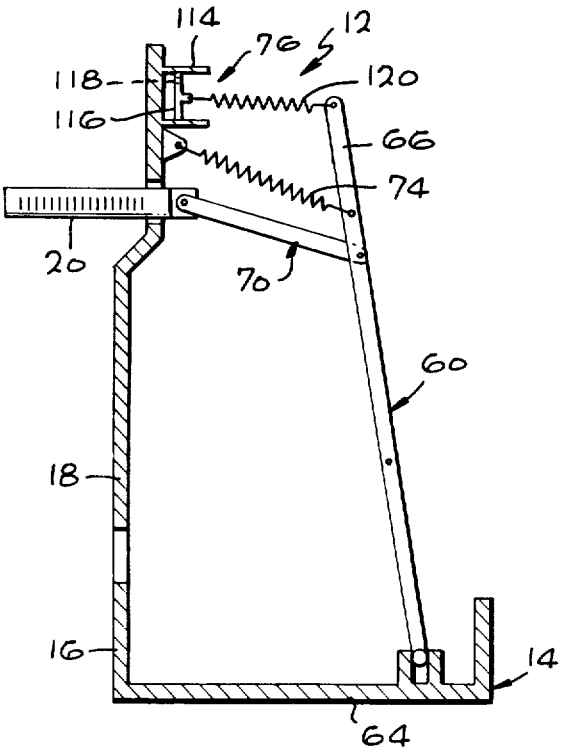
FIG. 8

DIESEL ENGINE STARTING CONTROL

BACKGROUND OF THE INVENTION

1. Field of the Invention

The present invention relates to fuel injection systems for internal combustion engines, and more particularly to a starting control for fuel injected compression ignition engines such as diesel engines.

2. History of the Prior Art

It is well known to provide a fuel injected diesel engine in which fuel is injected into the engine by an injection pump controlled in part by a governor which operates at a speed determined by the speed of the engine and which varies the quantity of fuel injected by an interconnecting control rack. A speed control lever determines the basic speed of the engine by varying the tension on a tensioning lever via a main governor spring. The resulting tension on the tensioning lever exerted by the spring counters the opposing force of flyweights within the governor. A floating lever within the fuel injection system assumes a position as determined by the tensioning lever to position the control rack accordingly and thereby adjust the amount of fuel injected into the engine. When the desired speed is obtained, the flyweight assembly counterbalances the tensioning lever to fix the position of the control rack and stabilize the amount of fuel injected.

For starting, the speed control lever is moved all the way to one extreme. The flyweight assembly offers no resistance, and the main governor spring and the starting spring pull the tensioning lever and the floating lever into extreme positions to move the control rack into a starting fuel position. While the starter is cranking the engine, the injection pump beings supplying fuel to the engine. Once the engine has started the flyweight assembly overcomes the starter spring and the control rack moves back to a position where the forces on the flyweight and the governor spring are balanced.

It is well established that engine geometry including bore size, connecting rod length to crankshaft throw ratio, compression ratio, valve timing, combustion bowl geometry, nozzle location, nozzle orifice size and angles all influence the startability of diesel engines. All of these factors are for the most part determined by considerations other than starting and cannot be conveniently varied during starting. In addition, the timing, the rate and the quantity of fuel which is injected into the combustion chamber during starting have a very important influence. Unfortunately, these factors typically cannot be optimized for both starting and operation at normal running speeds. Consequently, such factors are normally optimized for normal operation of the engine at some sacrifice in the startability of the engine.

It would be desirable to provide a fuel injected compression ignition engine in which the performance of the fuel injection system is optimized for both starting and running at normal speeds.

It would furthermore be desirable to provide a fuel injected diesel engine which is relatively easy to start at varying temperatures and which at the same time runs smoothly and efficiently once started. Any controls added to the fuel injection system should preferably not interfere with the normal operation of the fuel injection system after the engine is started and running.

BRIEF DESCRIPTION OF THE INVENTION

The present invention provides a diesel engine starting control which retards the return movement of the control rack of the fuel injection system out of the starting fuel position as a function of temperature so as to optimize starting of the engine. At the same time the starting control is released from or in any event does not interfere with normal operation of the fuel injection system and its control rack once the engine is started and running. Retardation of movement of the control rack out of the starting fuel position is provided by a damper the operation of which varies with the viscosity of oil therein as determined by the temperature. The damper is provided with a one-way check valve or similar apparatus to allow the control rack to be quickly returned to the starting fuel position in the event the initial starting effort fails and it becomes necessary to restart the engine. After the engine starts and begins to accelerate, the fuel injection system is no longer affected by the starting control which is either disconnected or caused to assume a position in which it does not hinder movement of the control rack or the other parts of the fuel injection system.

In one embodiment of a starting control according to the invention, the damper comprises a dashpot located within the governor housing of the fuel injection system so as to receive oil therein and including a plunger equipped with a check valve or similar device to permit quick return of the plunger to the bottom of the dashpot after it is raised within the dashpot. The plunger is coupled to control movement of the floating lever within the governor housing which in turn controls movement of the control rack. The plunger is coupled to the floating lever by a pivotably mounted crank, a rod coupling the plunger to the crank, and a pair of magnets mounted on the other end of the crank and the floating lever respectively. As the engine starts and the control rack begins to move out of the starting fuel position in response to forces exerted on the floating lever by the flyweight assembly of the governor, movement of the control rack is retarded by the dashpot so as to maintain the engine in a starting fuel condition long enough for it to start without stalling and begin to increase in speed and warmup. As the engine speed increases to a point where the large armounts of starting fuel are not needed, the resulting increased force provided by the flyweight assembly either separates the pair of magnets or eventually rotates the crank against an adjustable stop to separate the pair of magnets so that the starting control is thereafter disengaged from the fuel injection system until the next time the engine is to be started. The amount of resistance provided by the dashpot to movement of the control rack out of the starting fuel position increases with lower temperatures which increase the viscosity of the oil to hold the injection system in a high fuel condition for a longer period of time when the engine is being started at colder temperatures.

In an alternative embodiment the mounting of the crank relative to the floating lever is reversed as is the check valve in the plunger so that movement of the control rack out of the starting position requires that the plunger be pushed downwardly into the dashpot. Downward movement of the plunger is resisted by the oil. Upon movement of the control rack back into the starting position, however, relatively free upward movement of the plunger within the dashpot is provided by the reversed check valve.

In an alternative embodiment the crank and magnets are supplemented by a spring which additionally resists rapid motion of the control rack relative to the damper and which at the same time permits the control rack to be moved out of the starting fuel position in the event the starting control should stick for some reason.

BRIEF DESCRIPTION OF THE DRAWINGS

The foregoing and other objects, features and advantages of the invention will be apparent from the following more particular description of preferred embodiments of the invention, as illustrated in the accompanying drawings, in which:

FIG. 6 is a sectional view similar to FIG. 3 but showing a still different embodiment of a starting control according to the invention;

FIG. 7 is a sectional view similar to FIG. 3 but showing a still different embodiment of a starting control according to the invention; and FIG. 8 is a sectional view similar to FIG. 3 but showing a still different embodiment of a starting control according to the invention.

DETAILED DESCRIPTION

Figure 1:
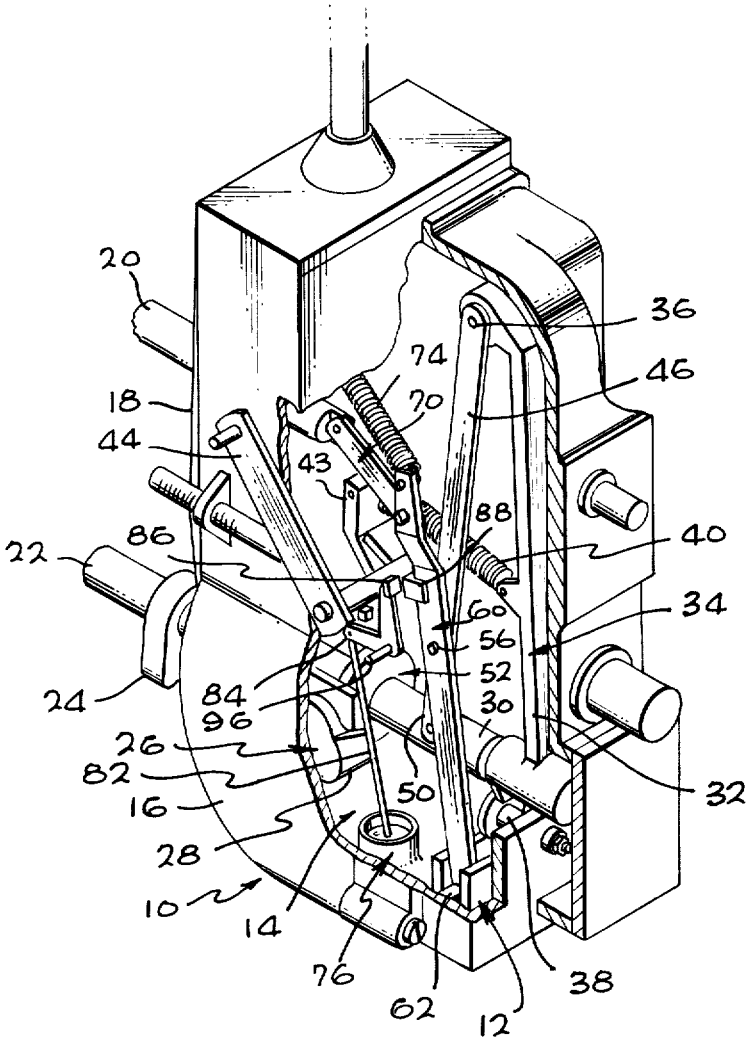
FIG. 1 is a perspective view, partly broken away, of a fuel injection governor equipped with a starting control according to the invention.
Figure 2:
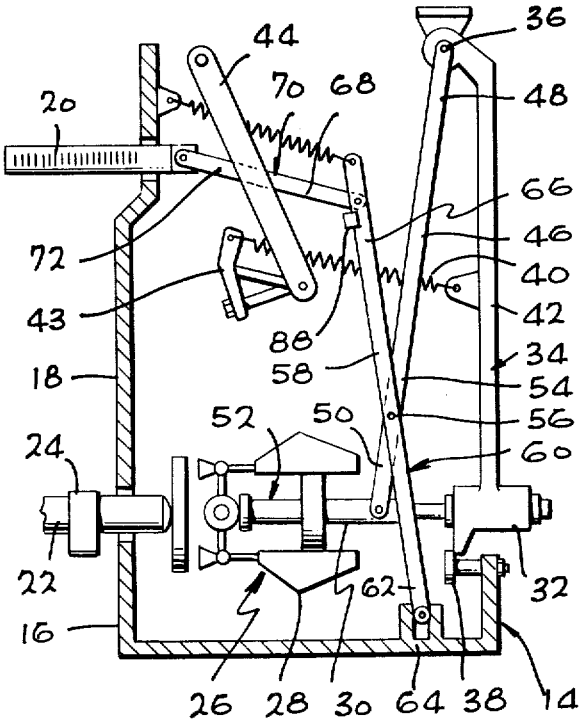
FIG. 2 is a sectional view of various parts of the governor of FIG. 1.

FIGS. 1 and 2 depict a fuel injection system 10 having a starting control 12 in accordance with the invention. The starting control 12 is illustrated in connection with a governor 14 for the fuel injection system 10. The governor 14 will be described and its operation explained only briefly in that it is of conventional design and operates in a fashion well known to those skilled in the art except for the presence of the starting control 12.

The governor 14 has a hollow housing 16 including a side wall 18. A control rack 20 and a cam shaft 22 extend in generally parallel, spaced-apart relation from the interior of the housing 16 through the side wall 18 to the outside of the governor. As is well known to those skilled in the art the cam shaft 22 is provided with a plurality of lobes along the length thereof (only one lobe 24 is shown in FIG. 1) which operate roller tappets to supply high pressure fuel through delivery valves to injection nozzles of an associated diesel engine. The control rack 20 is connected to the control sleeves and plungers to regulate the quantity of fuel delivered to the engine.

Mounted on the end of the cam shaft 22 within the housing 16 is a flyweight assembly 26. As the cam shaft 22 rotates, the flyweight assembly 26 also rotates, and a resulting centrifugal force causes weights 28 which form a part of the flyweight assembly 26 to move radially outwardly and thereby move an included shaft 30 along the axis of the cam shaft 22 and to the right as seen in FIGS. 1 and 2. The shaft 30 bears against the lower end 32 of a tensioning lever 34 pivotably coupled to the housing 16 via a shaft 36. Movement of the end 32 of the tensioning lever in the direction of the shaft 30 is limited by an adjustable stop 38.

Accordingly, with the cam shaft 22 at rest, the shaft 30 is disengaged from the lower end 32 of the tensioning lever 34. The tensioning lever 34 is in its extreme leftward position with the lower end 32 thereof held against the stop 38 by a main governor spring 40 coupled between an intermediate portion 42 of the tensioning lever 34 and a rocker arm 42 forming part of a speed control lever 44.

The tensioning arm 34 pivots about the shaft 36 in response to the relative forces exerted thereon by the main governor spring 40 and the shaft 30. Positioning of the speed control lever 44 positions the end of the spring 40 which is coupled to the rocker arm 42 thereof to determine the basic tension force of the spring 40 on the tensioning lever 34. With the engine running, the flyweight assembly 26 pushes the shaft 30 outwardly and against the lower end 32 of the tensioning lever 34 by an amount directly related to the speed of the cam shaft 22 and thereby the speed of the engine. The tensioning lever 34 assumes a position at which the opposing forces exerted thereon by the main governor spring 40 and the shaft 30 are equal. A guide lever 46 has an upper end 48 thereof privotably mounted on the shaft 36 together with the tensioning lever 34 and a lower end 50 thereof pivotably coupled to the shaft 30. The shaft 30 is coupled to the flyweight assembly 26 via a thrust sleeve and bearing 52 and does not rotate. Accordingly, the guide lever 46 pivots about the shaft 36 much in the same way as the tensioning lever 34. However, whereas leftward movement of the tensioning lever 34 is limited by the stop 38, the guide lever 46 can move as far to the left as the shaft 30 is capable of moving.

An intermediate portion 54 of the guide lever 46 is pivotably coupled via a shaft 56 to an intermediate portion 58 of a floating lever 60 having a lower end 62 thereof pivotably coupled to the bottom 64 of the governor housing 16. An opposite upper end 66 of the floating lever 60 is pivotably coupled to one end 68 of an elongated arm 70 having an opposite end 72 pivotably coupled to the end of the control rack 20. As the guide lever 46 pivots about the shaft 36 in response to movement of the shaft 30, the resulting lateral movement of the shaft 56 causes the floating lever 60 to pivot about its lower end 62 and thereby move the control rack 20 via the elongated arm 70. The upper end 66 of the floating lever 60 is also coupled to one end of a starting spring 74, the opposite end of which is coupled to the side wall 18 of the housing 16.

When the engine is to be started, the speed control lever 44 is rotated all the way to the left as seen in FIGS. 1 and 2. The main governor spring 40 exerts a large amount of tension on the tensioning lever 34. Since the engine is at rest, the shaft 30 is in its extreme lefthand position as viewed in FIGS. 1 and 2, allowing the lower end 32 of the tensioning lever 34 to rest against the stop 38. At the same time the guide lever 46 which has its lower end 50 coupled to the shaft 30 is pivoted to the left at the same time as the floating lever 60 which is coupled thereto is pivoted to the left under the urging of the starting spring 74. The floating lever 60 is rotated into an extreme lefthand position in which the control rack 20 is moved into a starting fuel position. As the engine is cranked and begins to fire, the increasing speed of the cam shaft 22 causes the flyweight assembly 26 to move the shaft 30 to the right. This pivots the guide lever 46 and the floating lever 60 to the right against the urging of the starting spring 74. As the floating lever 60 pivots to the right, the control rack 20 is pulled to the right to reduce the amount of the injected fuel. As engine speed continues to increase, the shaft 30 continues to move to the right until it eventually engages the lower end 32 of the tensioning lever 34 and moves the lower end out of contact with the stop 38. At this point the shaft 30 and the tensioning lever 34 operate as one. The guide lever 46 and the floating lever 60 move with the shaft 30 and in turn position the control rack 20 to vary the amount of the injected fuel. The fuel injection system reaches equilibrium when the amount of injected fuel is sufficient to cause the engine to run at a speed at which the force exerted by the flyweight assembly 26 is cancelled by the opposing force of the main governor spring 40. To slow the engine down the speed control lever 44 is rotated to the right as seen in FIGS. 1 and 2, thereby reducing the tension of the main governor spring 40 on the tensioning lever 34. This allows the flyweight assembly 26 to move the shaft 30 to the right. The resulting movement of the guide lever 46 and the floating lever 60 to the right moves the control rack 20 to the right to reduce the amount of injected fuel. This results in a decrease in engine speed and consequently the speed of the cam shaft 22. With the flyweight assembly 26 operating at a slower speed, the force exerted on the shaft 30 is reduced, and equilibrium is reached when the force of the flyweight assembly 26 is cancelled by the force of the main governor spring 40.

To increase the speed of the engine the speed control lever 44 is rotated to the left to increase the tension on the main governor spring 40. The force of the main governor spring 40 exceeds that of the flyweight assembly 26, and the shaft 30 and the included guide lever 46 are moved to the left. This pivots the floating lever 60 to the left so as to move the attached control rack 20 to the left and into a higher fuel position. The resulting increase in engine speed increases the force of the flyweight assembly 26 until it counterbalances the force of the main governor spring 40.

Starting difficulties, particularly in cold weather, are often experienced because of the speed at which the control rack 20 is pulled out of the starting fuel position by action of the flyweight assembly 26. However, adjustment of the flyweight assembly 26 to retard movement of the control rack 20 during starting would seriously affect the performance of the fuel injection system after starting when the flyweight assembly 26 forces the shaft 30 against the lower end 32 of the tensioning arm 34. Consequently, starting efficiency is sacrificed in favor of a relatively smooth running and efficient engine at normal operating speeds. Starting difficulties typically become most pronounced at cold temperatures. The rapid movement of the control rack 20 out of the starting fuel position provides considerably less fuel than may be required to start the engine under very cold conditions.

Starting of the engine can be broken down into four different periods. During the first or "first fire" period the engine is cracked by the starter to a speed of 60–120 rpm. During the second or "off starter" period the engine runs without benefit of the starter at a speed of 60–300 rpm. During the third or "on governor" period, combustion becomes efficient enough to develop sufficient power to accelerate the engine to a speed of 300–1200 rpm. During the fourth or "clear exhaust" period, combustion becomes efficient enough to eliminate large quantities of unburned or partly burned fuel in the exhaust. The engine runs at 800–1500 rpm. During the "first fire" and "off starter" periods, the governor begins to pull the control rack 20 out of the starting fuel position. At about 650 rpm which usually occurs during the "on governor" period, the governor pulls the control rack 20 out of both the retarded timing and excess fuel positions simultaneously and very rapidly. Based on this analysis it has been discovered in accordance with the invention that starting can be greatly improved by retarding movement of the control rack 20 out of the starting fuel position. The retardation of the control rack movement is desirably varied with temperature so that retardation and thereby the amount of starting fuel provided are greater at lower temperatures. However, retardation of movement of the control rack 20 should not interfere with operation of the governor at normal operating speeds.

Figure 3:
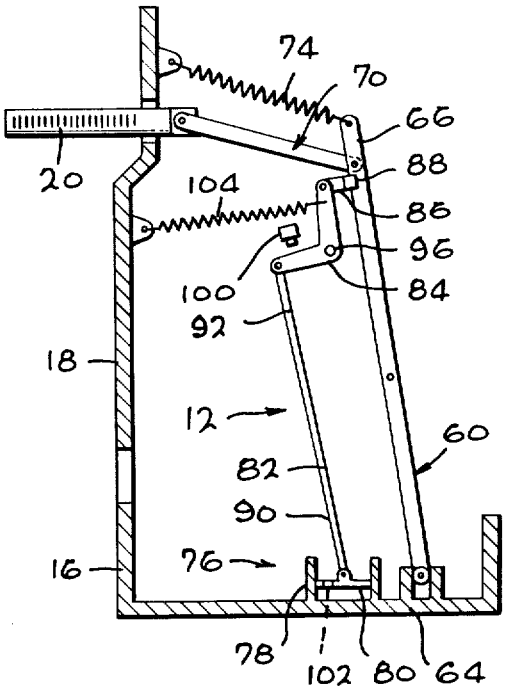
FIG. 3 is a sectional view similar to but simplified from the sectional view of FIG. 2 and illustrating the starting control in detail.

One preferred arrangement of a starting control 12 in accordance with the invention is shown in FIGS. 1 and 3. The starting control 12 includes a damper 76 comprising a dashpot 78 disposed on the bottom 64 of the governor housing 16 and having a movable plunger 80 therein. In the present example the dashpot 78 is integrally formed with the bottom 64 of the governor housing 16 such that the walls thereof are integral with and extend upwardly from the bottom 64 to form the cylindrical well. The plunger 80 is generally disk shaped and has a diameter slightly smaller than the internal diameter of the dashpot 78. The splash oil system within the governor 14 keeps the dashpot 78 filled with oil. Upward movement of the plunger 80 within the dashpot 78 is resisted in accordance with the viscosity of the oil and the relatively small clearance between the plunger 80 and the inner wall of the dashpot 78.

As described hereafter the dashpot 78 is operative to retard movement of the control rack 20 out of the starting fuel position upon starting of the engine. The dashpot 78 is designed to provide a desired amount of retardation which varies with temperature due to the changing viscosity of the oil. The lower the temperature, the more viscous the oil is and the greater the resistance to upward movement of the plunger 80. Consequently the control rack 20 moves out of the starting fuel position relatively slowly so as to maintain the fuel injection system in a high fuel delivery state which is necessary for cold starting. When the temperature is higher, the oil is less viscous, the resistance to upward movement of the plunger 80 is less and the control rack 20 moves out of the starting fuel position more rapidly.

The dashpot 78 retards movement of the control rack 20 out of the starting fuel position by being coupled to the floating lever 60. The coupling is effected via an elongated rod 82, a crank 84 and a pair of magnets 86 and 88. The elongate rod 82 has a first end 90 thereof pivotably coupled to the plunger 80 and an opposite second end 92 thereof pivotably coupled to a first end 94 of the crank 84. The crank 84 is pivotably mounted on a shaft 96 at a point intermediate the first end 94 and a second end 98 thereof. The shaft 96 is mounted on the wall of the housing 16. The first magnet 86 is mounted on the second end 98 of the crank 84, while the second magnet 88 is mounted on the floating lever 60 adjacent the upper end 66 thereof.

FIG. 3 depicts the starting control 12 when the engine is about to be started. Pivoting movement of the floating lever 60 to the left in response to the starting spring 74 moves the control rack 20 to the left into the starting fuel position. The magnets 86 and 88 which are of opposite polarity engage one another to couple the floating lever 60 to the dashpot 78 via the crank 84 and the elongated rod 82. In this position the plunger 80 of the dashpot 78 is at or close to the bottom of the dashpot 78. As the engine starts and the flyweight assembly 26 begins to exert force on the floating lever 60 via the guide lever 46 to pivot the floating lever 60 to the right, such motion is resisted by the dashpot 78. The resistance is of an appropriate amount and duration so as the retard movement of the control rack 20 out of the starting fuel position and thereby enhance the starting of the engine. As the plunger 80 moves up within the dashpot 78, the crank 84 pivots to the right allowing the floating lever 60 to rotate the right and slowly withdraw the control rack 20 from starting position. Eventually, a point is reached at which the force of the flyweight assembly 26 on the floating lever 60 overcomes the attractive force between the magnets 86 and 88, and the magnets 86 and 88 break apart from each other to thereby uncouple the starting control 12 from the governor 14. This may or may not occur prior to the crank 84 reaching an optional adjustable limit stop 100. The limit stop 100 stops the crank 84 and forces the magnets 86 and 88 apart at a point where retardation of the control rack 20 is no longer needed and the governor is to be freed of the starting control 12.

Figure 4:
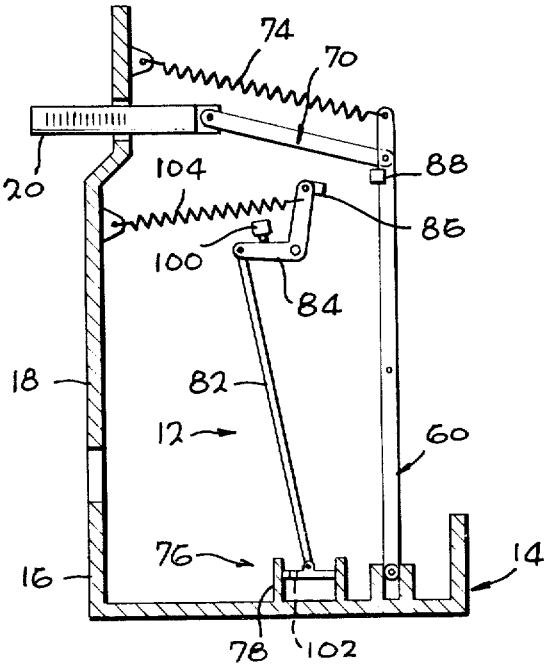
FIG. 4 is a sectional view like that of FIG. 3 except with the starting control and related components in a different position.

FIG. 4. shows the condition in which the crank 84 has engaged the limit stop 100 and the magnets 86 and 88 have separated. At that point the governor 14 controls the engine at normal operating speeds unaffected by the starting control 12. The starting control 12 may remain in this position until the floating lever 60 is again rotated to the left to move the control rack 20 into the starting fuel position in preparation for starting the engine. When that happens the magnets 86 and 88 engage one another and the crank 84 rotates to drive the plunger 80 to the bottom of the dashpot 78. The plunger 80 is preferably provided with a one-way device in the form of a check valve 102 which permits relatively free passage of oil in a direction from the bottom to the top of the plunger 80 to permit rapid return of the plunger 80 to the bottom of the dashpot 78. However, the check valve 102 does not permit oil to flow therethrough from the top to the bottom of the plunger 80, and therefore it does not interfere with the resistance of the plunger 80 to upward movement thereof.

An optional spring 104 may be provided to return the starting control 12 to the starting position upon separation of the magnets 86 and 88. The spring 104 has one end thereof coupled to the crank 84 adjacent the crank end 98 and the opposite end coupled to the side wall 18 of the housing 16. Upon separation of the magnets 86 and 88, the spring 104 rotates the crank 84 to drive the elongated rod 82 and the coupled plunger 80 downwardly into the starting position in preparation for the next start of the engine.

As previously described the magnets 86 and 88 are operative to separate and thereby uncouple the starting control 12 from the governor 14 is response to a force exceeding a predetermined valve. In addition to uncoupling the starting control 12 from the governor when the engine reaches a normal range of operating speeds, this feature also safeguards against a runaway engine condition which might otherwise occur if the starting control 12 stuck or otherwise were held so as to maintain the control rack 20 in the starting fuel position after the engine starts.

Figure 5:
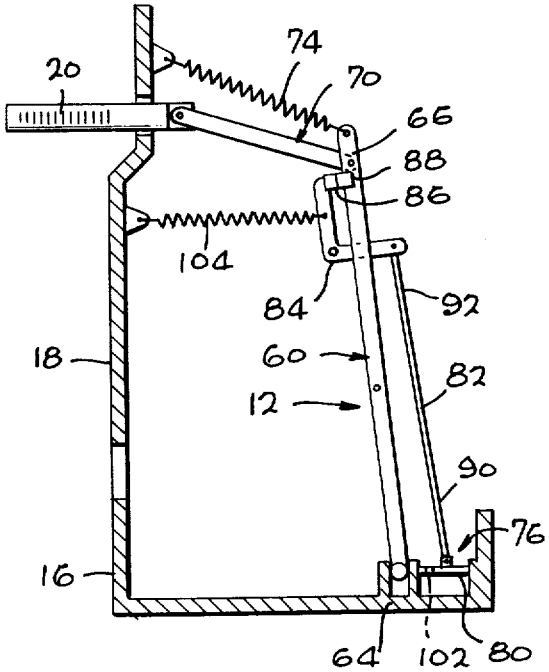
FIG. 5 is a sectional view similar to FIG. 3 but showing a different embodiment of a starting control according to the invention.

An alternative embodiment of a starting control 12 in accordance with the invention is shown in FIG. 5. The starting control 12 of FIG. 5 is like the starting control shown in FIGS. 3 and 4 except that the crank 84 is reversed so as to place the elongated rod 82 and the dashpot 78 on the opposite side of the floating lever 60 from the control rack 20. Consequently the plunger 80 is pushed downwardly into the dashpot 78 as the control rack 20 is pulled out of the starting position by the floating lever 60 via the elongated arm 70. The check valve 102 is reversed so as to resist upward flow therethrough while permitting relatively free flow of oil in a downward direction therethrough. Thus, as the control rack 20 is pulled out of the starting position, the resulting rotation of the crank 84 pushes the plunger 80 downwardly within the dashpot 78. Rapid or erratic movement is resisted by the oil which cannot flow through the check valve 102 and which must therefore gradually flow through the narrow space between the outer edge of the plunger 80 and the walls of the dashpot 78.

As in the case of the starting control 12 of FIGS. 3 and 4, the magnets 86 and 88 in the embodiment of FIG. 5 eventually separate so as to free the operation of the control rack 20 from the control 12. This may occur whenever the force is great enough, or in any event when the plunger 80 reaches the bottom of the dashpot 78. Alternatively, the limit stop 100 shown in FIGS. 3 and 4 may be used to provide separation of the magnets 86 and 88 prior to the plunger 80 reaching the bottom of the dashpot.

When the magnets 86 and 88 separate in the starting control 12 of FIG. 5, the crank 84 rotates counterclockwise as seen in the figure under the urging of the spring 104. At the same time the elongated rod 82 is pulled upwardly, raising the plunger 80 in the dashpot 78. The check valve 102 permits relatively free fluid flow in a downward direction therethrough, and consequently the dashpot 78 offers little resistance to upward movement of the elongated rod 82. Therefore, upon separation of the magnets 86 and 88, the starting control 12 moves quickly into the starting position in preparation for restarting or the next starting of the engine when the control rack 20 is moved leftwardly into the starting position and the magnets 86 and 88 engage.

A further alternative embodiment of a starting control 12 in accordance with the invention is shown in FIG. 6. The starting control 12 of FIG. 6 is like the starting control shown in FIGS. 3 and 4 except that the second end 92 of the crank 84 is coupled to the upper end 66 of the floating lever 60 by a spring 106 instead of the magnets 86 and 88. The spring 106 resists rapid movement of the floating lever 60 relative to the crank 84 so as to effectively couple the crank to the floating lever as the control rack 20 is pulled out of the starting fuel position against the resistance of the dashpot 78. However, as the floating lever 60 continues to rotate to the right under the urging of the flyweight assembly 26 the spring 106 expands as necessary so as to substantially reduce the influence of the crank 84 and the rest of the starting control 12 on the floating lever 60 during operation of the engine at normal running speeds. Since the spring 106 continues to urge the floating lever 60 to the left with some force, it may be possible to eliminate the starting spring 74 in some designs or applications.

In the embodiment of FIG. 6, the starting control 12 typically returns to the starting position under the urging of the spring 104 with the plunger 80 at or close to the bottom of the dashpot 78 after the engine has started and the control rack 20 is in a low load fuel position.

A further alternative emmbodiment of a starting control 12 in accordance with the invention is illustrated in FIG. 7. The arrangement of FIG. 7 utilizes the dashpot 78 with its plunger 80 and included check valve 102. However, the elongated rod 82 and the crank 84 in the arrangements of FIGS. 3, 4, 5 and 6 are replaced by a shorter elongated rod 108, an elongated arm 110 extending transversely from the floating lever 60 adjacent the upper end 66 thereof and a spring 112 extending between and coupled to the rod 108 and the arm 110. The spring 112 resists rapid motion of the floating lever 60 and its included arm 110 relative to the rod 108 and attached plunger 80 so as to effectively couple the dashpot 78 to the floating lever 60 during starting of the engine. When the engine reaches normal running speeds, however, the gradual tension on the spring 112 allows the floating lever 60 to act as though it is uncoupled from the rod 108 and the dashpot 78 except during transitions from low load to high load where the starting control 12 provides some damping and retardation. Prior to starting, the starting spring 74 rotates the floating lever 60 to the left and into the starting fuel position. At the same time the arm 110 compresses the spring 112 to drive the elongated rod 108 downwardly so that the coupled plunger 80 assumes the starting position within the dashpot 78. Thereafter the spring 112 and the damper 76 combine to retard quick movement of the control rack 20 out of the starting fuel position, following which the spring 112 flexes sufficiently to allow relative free movement of the floating lever 60 unimpaired by the starting control 12 as the engine reaches normal operating speeds.

A still further embodiment of the starting control 12 in accordance with the invention is shown in FIG. 8. In the prior embodiments the dashpot 78 comprising the damper 76 is disposed at the bottom 64 of the housing 16 with its axis generally vertical. The splash oil system within the governor 14 keeps the dashpot filled with oil. In the embodiment of FIG. 8, the damper 76 comprises an air-operated dashpot 114 mounted on the side wall 18 of the housing 16 above the control rack 20 with its central axis generally horizontal. The dashpot 114 includes a plunger 116 having a check valve 118. The upper end 66 of the floating lever 60 is made longer than in the other embodiments and is coupled to one end of a spring 120 having its opposite end coupled to the plunger 116.

The starting control 12 of FIG. 8 operates in much the same way as the embodiment of FIG. 7. As the engine is started, rapid motion of the floating lever 60 relative to the dashpot 114 is resisted by the spring 120 as the dashpot 114 applies the desired amount of retardation force. However, as the floating lever 60 continues to rotate to the right and the engine reaches normal operating speeds, the spring 120 extends to permit relatively free movement of the floating lever 60 relative to the starting control 12. Prior to starting, the starting spring 74 returns the floating lever 60 to the starting position. The plunger 116 quickly moves to the bottom of the dashpot 114 due to the action of the check valve 118.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In an arrangement in which a governor-operated control rack controls fuel injection in a diesel engine, the control rack being moved into a starting position when the diesl engine is to be started and being moved out of the starting position by the governor upon starting of the diesel engine, the improvement comprising means for retarding movement of the control rack out of the starting position comprising damper means and means coupling the damper means to the control rack to retard movement of the control rack out of the starting position by the damper means, the means coupling the damper means to the control rack including means for permitting at least some movement of the control rack relative to the damper means when the retarding force exerted on the control rack by the damper means and the means coupling exceeds a predetermined value, the damper means retarding movement of the control rack out of the starting position with a force of selected value and resisting movement of the control rack into the starting position with a force substantially less than said force of selected value, the damper means comprising a dashpot having a plunger with a one-way check valve therein.

2. In an arrangement in which a governor-operated control rack controls fuel injection in a diesel engine, the control rack being moved into a starting position when the diesel engine is to be started and being moved out of the starting position by the governor upon starting of the diesel engine, the improvement comprising means for retarding movement of the control rack out of the starting position comprising damper means and means coupling the damper means to the control rack to retard movement of the control rack out of the starting position by the damper means, the means coupling the damper means to the control rack including means for permitting at least some movement of the control rack relative to the damper means when the retarding force exerted on the control rack by the damper means and the means coupling exceeds a predetermined value, the means coupling the damper means to the control rack including a crank having a pair of opposite ends a first one of which is pivotably coupled to the means for permitting at least some movement and pivotably mounted at a portion thereof intermediate the pair of opposite ends, an elongated rod having a pair of opposite ends, one of which is pivotably coupled to the other one of the pair of opposite ends of the crank and the other of which is pivotably coupled to the damper means.

3. The invention set forth in claim 2, further including adjustable means for stopping rotation of the crank beyond a selected point in a first direction to permit movement of the control rack out of the starting position.

4. The invention set forth in claim 3, further including resilient means coupled to the crank to urge rotation of the crank in a second direction opposite the first direction.

5. An arrangement for controlling movement of a fuel injection control rack for an engine comprising a fuel injection control rack, an elongated floating lever, means pivotably mounting the floating lever, an elongated rod extending between and coupled to the control rack and the floating lever, means for exerting a force on the floating lever to tend to rotate the floating lever in a first direction about the pivotable mounting thereof, the force varying directly with the speed of the engine, resilient means coupled to the floating lever to tend to rotate the floating lever in a second direction opposite the first direction about the pivotable mounting thereof, a dashpot including a movable plunger therein, a crank having an opposite pair of ends and pivotably mounted at a point intermediate the opposite pair of ends, an elongated element having one end thereof pivotably coupled to one of the opposite pair of ends of the crank and an opposite end pivotably coupled to the plunger, and means coupling the other one of the opposite pair of ends of the crank to the floating lever.

6. The invention set forth in claim 5, further including second resilient means coupled to the crank, adjustable stop means for limiting rotation of the crank and check valve means disposed within the plunger.

7. The invention set forth in claim 5, wherein the means coupling the other one of the opposite pair of ends of the crank to the floating lever comprises a first magnetic element mounted on the crank at the other one of the opposite pair of ends thereof and a second magnetic element mounted on the floating lever.

8. The invention set forth in claim 5, wherein the means coupling the other one of the opposite pair of ends of the crank to the floating lever comprises a spring.

9. An arrangement for controlling movement of a fuel injection control rack for an engine comprising a fuel injection control rack, an elongated floating lever, means pivotably mounting the floating lever, an elongated rod extending between and coupled to the control rack and the floating lever, means for exerting a force on the floating lever to tend to rotate the floating lever in a first direction about the pivotable mounting thereof, the force varying directly with the speed of the engine, a dashpot including a movable plunger therein, and means including a spring coupling the plunger to the floating lever whereby the spring normally exerts a force in a direction to tend to rotate the floating lever in a second direction opposite the first direction and the dashpot retards rotation of the floating lever in the first direction in response to the means for exerting a force on the floating lever.

10. The invention set forth in claim 9, wherein the arrangement further includes a housing having a bottom, the floating lever is pivotably mounted on the bottom of the housing, the dashpot is disposed on the bottom of the housing and the floating lever includes an arm extending outwardly therefrom and coupled to the spring.

11. The invention set forth in claim 9, wherein the arrangement further includes a housing having a bottom and a side wall, the floating lever is pivotably mounted on the bottom of the housing, and the dashpot is disposed on the side wall of the housing at a level to dispose the spring generally horizontally between the dashpot and the floating lever.

* * * * *